United States Patent [19]

Anzola et al.

[11] Patent Number: 4,673,585

[45] Date of Patent: Jun. 16, 1987

[54] PROCESS FOR THE PREPARATION OF THE SURFACE OF URANIUM OR URANIUM-BASED ALLOY PARTS

[75] Inventors: Michel Anzola, Bretigny; Daniel Lefevre, Longvilliers; Patrick Massicot, Vanves; Jacques Pierre, Montrouge; Antoine Henry, Ivry-sur-Seine, all of France

[73] Assignee: Commissariat a l'Energie Atomique, Paris, France

[21] Appl. No.: 752,595

[22] Filed: Jul. 8, 1985

[30] Foreign Application Priority Data

Jul. 18, 1984 [FR] France ..... 84 11387

[51] Int. Cl.[4] ..... C23F 1/30

[52] U.S. Cl. ..... 427/6; 427/309; 156/664; 252/79.2; 252/79.3

[58] Field of Search ..... 427/6, 309; 156/664; 252/79.2, 79.3

[56] References Cited

U.S. PATENT DOCUMENTS 2,894,884 7/1959 Gray ..... 156/664
2,928,168 3/1960 Gray ..... 427/309
3,700,482 10/1972 Jecky ..... 427/6

FOREIGN PATENT DOCUMENTS 1564575 4/1969 France .
2017505 5/1970 France .
363871 9/1962 Switzerland .

OTHER PUBLICATIONS

Metal Finishing, vol. 74, No. 3, Mar. 1976, pp. 37–42; H. R. Johnson et al., "Etching and Plating of Uranium Alloys" * p. 38, appendix; p. 39, Tableau I *.

*Primary Examiner*—Sam Silverberg
*Attorney, Agent, or Firm*—Oblon, Fisher, Spivak, McClelland & Maier

[57] ABSTRACT

Process for the preparation of the surface of a uranium or uranium alloy part. It comprises a stage of chemically etching the surface of the uranium or uranium alloy part by means of a solution of nickel chloride and hydrochloric acid. The etching solution may also contain hydrofluoric acid.

The nickel-coated uranium or uranium alloy parts can be used as shielding or ballasting members in a marine atmosphere.

15 Claims, 1 Drawing Figure

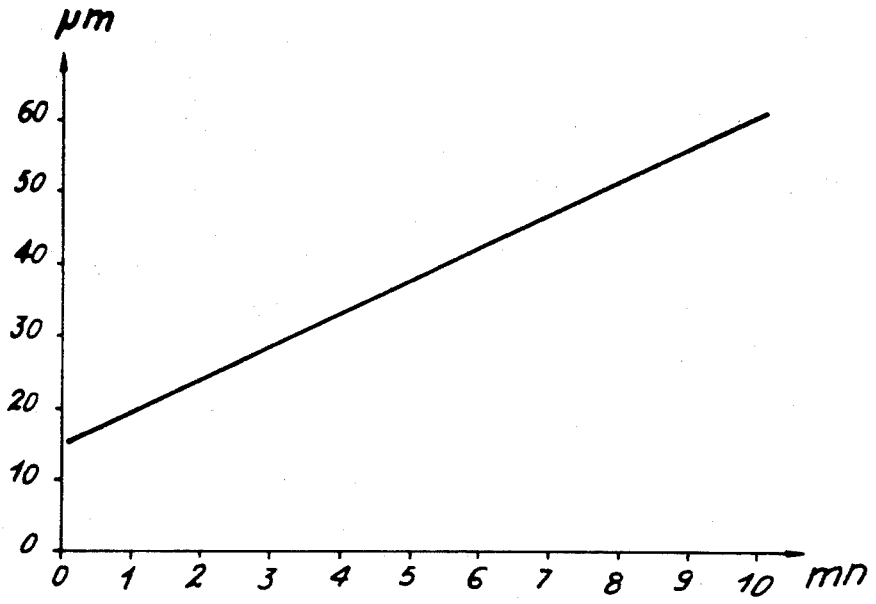
μm
60
50
40
30
20
10
0
0
1
2
3
4
5
6
7
8
9
10
mn

PROCESS FOR THE PREPARATION OF THE SURFACE OF URANIUM OR URANIUM-BASED ALLOY PARTS

BACKGROUND OF THE INVENTION

The present invention relates to a process for the preparation of the surface of uranium parts or uranium-based alloy parts, carried out with a view to obtaining on said parts nickel coatings by using a chemical nickel-plating process.

In several fields, it is often necessary to deposit nickel coatings on uranium or uranium alloy parts. Generally these coatings are produced by electrolytic nickel-plating, which makes it possible to obtain coatings with a satisfactory quality. However, these electrolytic nickel-plating processes are not suitable for the treatment of parts having a complicate shape, e.g. with reentrant angles and/or holes because, in this case, it is difficult to obtain a uniform nickel deposit thickness and sometimes it is even difficult to entirely coat the surface of the parts. In addition, in the case of parts having a complicated shape, it is preferable to carry out nickel deposition chemically, in order to overcome these difficulties.

However, in order to obtain a nickel coating having an adequate adhesion by chemical nickel-plating, it is firstly necessary to subject the part to a preparatory surface treatment which can e.g. be carried out by chemical etching and which must lead to a uniform and thickness-controllable etching, so that the surface of the part is able to receive the nickel deposit.

Several surface treatments of this type are described in French Pat. No. 1 564 575 filed by the C.E.A. These treatments can in particular comprise trichloroethylene cleaning, cathodic electrolytic cleaning and pickling using nitric and hydrochloric acids. It is also possible to replace the hydrochloric acid by a solution of copper chloride and hydrochloric acid, or carry out a complementary electrolytic pickling stage in a sodium acetate solution.

Such treatments lead to a satisfactory result, except in the case of parts having a complicated shape, where it is difficult to obtain a homogeneous, thickness-uniform etching over the entire surface of the part.

The present invention specifically relates to a process for the preparation of the surface of a uranium or uranium alloy part making it possible to obtain a good surface state over the complete part.

SUMMARY OF THE INVENTION

The process according to the invention is characterized in that it comprises a stage of chemically etching the surface of the uranium or uranium alloy part by means of a solution of nickel chloride and hydrochloric acid.

The choice, according to the invention, of an etching solution constituted by a nickel chloride $NiCl_2$ and hydrochloric acid solution makes it possible to obtain improved results compared with those obtained with the prior art solutions, particularly those described in French Pat. No. 1 564 575. Thus, as a result of this choice, a fine regular, slower etching effect is obtained than with the $CuCl_2$ solution, which makes it possible to obtain a satisfactory surface state over the complete part, even when the latter has a complicated shape. Thus, etching is not too fast and can consequently easily be controlled. Moreover, the thickness etched as a function of time is linear. The use of these solutions is advantageous, because they do not evolve in time and thus have a good storage stability.

Preferably, the nickel chloride $NiCl_2$ concentration of the solution is 600 to 700.$l^{-1}$ and the hydrochloric acid concentration of the solution is 1.8 to 2.2 mol.$l^{-1}$. For example, the etching solution can be an aqueous solution containing approximately 615 g.$l^{-1}$ of $NiCl_2$ and approximately 2 mol.$l^{-1}$ of HCl.

Generally, this chemical etching is carried out at ambient temperature for 5 to 10 minutes.

According to a variant of the invention, 1.5 to 5.6 mol.$l^{-1}$ of hydrofluroic acid can be added to the etching solution, which makes it possible to reduce the etching speed without as such modifying the appearance of the etched surface.

Generally, before carrying out this chemical etching, the uranium or uranium alloy part undergoes at least one of the following treatments:

cleaning by an organic solvent,
sandblasting,
pickling in a soda solution,
pickling in a nitric acid solution.

In the same way, following the chemical etching stage, it is preferably to subject the uranium or uranium alloy part to at least one of the following treatments:

pickling with nitric acid,
pickling with a soda solution.

The pickling operation or operations using the soda solution are preferably carried out hot, e.g. at a temperature of 75° C.

According to a preferred embodiment of the process according to the invention, the process for the preparation of the surface of a uranium or uranium alloy part comprises the following successive stages:

cleaning by an organic solvent, such as trichloroethylene or perchloroethylene,
wet sandblasting,
hot pickling with a soda solution, followed by rinsing in water,
pickling with a nitric acid solution, followed by rinsing in water,
chemical etching using a solution of nickel chloride $NiCl_2$ and hydrochloric acid, followed by rinsing in water,
pickling with a nitric acid solution, followed by rinsing in water,
pickling with a soda solution, followed by rinsing in water,
pickling with a nitric acid solution, followed by rinsing in water.

All these operations makes it possible to obtain a surface state with a satisfactory quality, particularly when the treated part is a uranium-vanadium alloy part containing 0.2% by weight of vanadium.

Generally the nitric acid solution pickling operations are carried out at ambient temperature by means of a solution containing 7 to 9 mol.$l^{-1}$ of nitric acid, e.g. a 8 mol.$l^{-1}$ nitric acid solution, for between 8 and 15 minutes.

For the soda solution pickling stages, working generally takes place at a temperature of 70° to 85° C. and use is made of a solution containing 250 to 350 g.$l^{-1}$ of soda, whereby the duration of said pickling operation can be between 3 and 7 minutes.

The uranium or uranium alloy parts treated by the process of the invention can then be nickel coated by chemical nickel-plating in an aqueous solution. For this nickel-plating operation, use is m made of NIPOSIT 65 solutions marketed by SHIPLEY S. A.

DESCRIPTION OF THE DRAWING AND PREFERRED EMBODIMENTS

The invention will be better understood from the following embodiments given in a non-limitative manner with reference to the attached drawing, which is a graph showing the etched alloy thickness (in μm), as a function of the time during which the chemical etching stage is performed (in minutes).

These examples illustrate the treatment of uranium-vanadium alloy parts containing 0.2% by weight vanadium and being in the form of cylinders.

In all the examples, the treatment comprises the following successive stages:

cleaning with an organic solvent,
wet sandblasting,
pickling in a 300 $g.l^{-1}$ soda solution at 75° C. for 5 minutes,
rinsing in soft water,
pickling in a 8 $mol.l^{-1}$ nitric acid solution for 2 minutes at ambient temperature,
rinsing with soft water,
chemical etching,
rinsing with soft water,
pickling in a 8 $mol.l^{-1}$ nitric acid solution at ambient temperature for 12 minutes.
rinsing with soft water,
pickling in a 300 $g.l^{-1}$ soda solution at 75° C. for 5 minutes,
rinsing with soft water,
pickling with a 8 $mol.l^{-1}$ nitric acid solution at ambient temperature for 2 minutes,
rinsing with soft water.

EXAMPLES 1 TO 7

In these examples, etching is carried out by means of an aqueous solution containing 615 $g.l^{-1}$ of $NiCl_2$ and 1.99 $mol.l^{-1}$ of hydrochloric acid for periods between 0.5 and 10 minutes, the etched thickness being measured in each case. In addition, the value of Ra (in μm) is determined. The results obtained are given in table 1 and in the attached graph, which represents the etched thickness (in μm), as a function of the duration of the chemical etching stage (in minutes).

Thes results show that the etching speed is constant (4.6 μm/min), the etched thickness has a function of time being linear.

In the drawing, the ordinate to origin displacement indicates that the uranium-vanadium alloy is slowly etched during the preliminary pickling stages. If hydrofluoric acid is added to the etching solution, the etching speed is decreased, but the etched thickness still increases linearly as a function of time.

Moreover, it can be seen that the appearance of the etched surface is not modified, even after etching with the $NiCl_2$-HCl solution for up to 10 minutes. Thus, the structures remain fine, even for etched thicknesses of 30 to 40 μm and the final appearance of the parts is not prejudiced, which constitutes an essential difference compared with the use of the $CuCl_2$ solution, which involves etching by puncturing and gives a non-uniform appearance.

TABLE 1

| Example | Etched thickness (μm) | Chemical etching time (in min) | Ra (in μm) |
|---|---|---|---|
| Control | 0 | 0 | 1.5 |
| 1 | 17 | 0.5 | 3 |
| 2 | 19 | 1 | 4 |
| 3 | 32 | 3.5 | 7 |
| 4 | 38 | 5 | 8 |
| 5 | 40 | 5 | 9 |
| 6 | 49 | 7 | >10 |
| 7 | 60 | 10 | >10 |

EXAMPLES 8 TO 12

In these examples, use is made of the same etching solution as in examples 1 to 7 and of chemical etching times of 5 or 10 minutes. The results obtained are given in the following table 2.

TABLE 2

| Example | Etching time | Thicknesses removed during the various experiments in μm |
|---|---|---|
| 8 | 5 min | 41 |
| 9 | 5 min | 40 |
| 10 | 5 min | 38 |
| 11 | 10 min | 59 |
| 12 | 10 min | 60 |

Thus, there is a good etching reproducibility.

EXAMPLES 13 TO 22

In these examples, use is made of the etching solutions of the above table 3 for carrying out chemical etching. The results obtained are given in table 3. On the basis of these results, it can be seen that only the solution of nickel chloride $NiCl_2$ and HCl makes it possible to obtain satisfactory results.

| Example | Etching solution | Etching characteristics |
|---|---|---|
| 13 | aqueous 1400 $g.l^{-1}$ $FeCl_3$ solution | excessively fast etching, even at ambient temperature |
| 14 | aqueous solution of 378 $g.l^{-1}$ of $AlCl_3$ and 1.2 $mol.l^{-1}$ of HCl | excessive etching for the parts |
| 15 | aqueous solution of 460 $g.l^{-1}$ of LiCl | no etching |
| 16 | solution of 460 $g.l^{-1}$ of LiCl and 1 $mol.l^{-1}$ of HCl | inadequate etching |
| 17 | aqueous solution of 460 $g.l^{-1}$ of LiCl and 1.6 $mol.l^{-1}$ of HCl | excessive etching, tolerable appearance |
| 18 | aqueous solution of 1000 $g.l^{-1}$ of $NzCl_2$ and 2.8 $mol.l^{-1}$ of $HNO_3$ | non-uniform etching, unetched areas |
| 19 | aqueous 650 $g.l^{-1}$ of $CuCl_2$ solution | excessively fast etching, even at ambient temperature |
| 20 | aqueous 615 $g.l^{-1}$ of $NiCl_2$ solution | excessively fast and non-uniform etching, even at ambient temperature |
| 21 | aqueous 615 $g.l^{-1}$ of $NiCl_2$ solution and various $HNO_3$ concentrations | irregular etching, no reproducibility, instability of etching solution |
| 22 | aqueous solution of 615 $g.l^{-1}$ of $NiCl_2$ 1.992 $mol.l^{-1}$ of HCl | satisfactory, fine, regular etching |

EXAMPLES 23 TO 28

In these examples, use is made of the same etching solution as in examples 1 to 7 for different times. A nickel coating is then deposited on the parts using a commercial NIPOSIT 65 solution for the chemical-plating process.

Tests are then carried out on the adhesion of the nickel deposit using a Quad Tester Coating adhesion machine, i.e. studs stuck to the coating the then pulled.

The results obtained are given in the following table 4, which also shows the etched thickness and the thickness of the nickel coating corresponding to each example.

TABLE 4

| Example | Etched thickness (in μm) | Chemically deposited Ni thickness (in μm) | Adhesion (in MPa) for e.g. 3 measurements |
|---|---|---|---|
| 23 | 19 | 18 | 71.6; 71.9; 72.4 |
| 24 | 21 | 15 | 71.8; 72.3; 73.2 |
| 25 | 59 | 15 | 58.4; 69.3; 68.0 |
| 26 | 41 | 15 | 68.3; 64.8; 68.6 |
| 27 | 26 | 15 | 72.4; 72.1; 71.9 |
| 28 | 41 | 15 | 69.5; 72.1; 66.7 |

On the basis of these results, it can be seen that in no sample is there a tearing away of the deposit, breaking always occurring in the glue joint. Thus, there is an excellent adhesion, which is certainly as good as the tensile strength of brazed joints of the Castotin No. 1 type (60/40) as can be seen in table 5, which gives the results of brazing tests on the base and side of the cylinder carried out on the parts of examples 23 to 28. These tests were carried out on heating plates, where the substrate is raised to the temperature necessary for melting the flux and the brazed joint.

For these brazed joint tests, use was made of a more moderate heating employing a rheostat and applying a voltage of 200 V. The brazed joint resistance for all the samples is approximately 80 MPa, except in example 24, where there was a slight tearing away.

TABLE 5

| Samples II | Brazing on the base of the cylinder (with traces of adhered stud) | Brazing on the sides of the cylinder |
|---|---|---|
| 23 | good | good |
| 24 | good | slight tearing away, 90% good |
| 25 | good | good |
| 26 | good | good |
| 27 | good | good |
| 28 | good | good |

EXAMPLES 29 AND 30

These examples use the same etching solution as in examples 1 to 7 and etching was carried out for a time such that the etched thickness is 30 μm. The parts were then covered with a 30 μm (example 29) and 60 μm (example 30) nickel coating by chemical nickel-plating in a Shipley NiP65 bath.

The thus treated parts were then subjected to the action of a salt mist and it was possible to see that the part provided with a 30 μm nickel coating resisted for 168 hours and the part provided with a 60 μm nickel coating for more than 316 hours an atmosphere of the indicated type. The thus treated parts also had a good resistance to a marine atmosphere.

The uranium or uranium alloy parts made from depleted uranium, then treated by the process according to the invention and the coated with nickel by chemical nickel-plating can be used as shielding or ballasting members in a marine atmosphere.

What is claimed is:

1. A process for the preparation of the surface of a uranium-vanadium part, comprising chemically etching the surface of the said uranium-vanadium part by means of a solution of nickel chloride and hydrochloric acid.

2. The process according to claim 1, wherein the said etching solution further comprises 1.5 to 5.6 $mol.l^{-1}$ of hydrofluoric acid.

3. The process according to claim 1 or 2, wherein the said nickel chloride concentration of the solution is 600 to 700 $g.l^{-1}$.

4. The process according to claim 1 or 2, wherein the said hydrochloric acid concentration of the solution is 1.8 to 2.2 $mol.l^{-1}$.

5. The process according to claim 1, wherein the said etching solution contains approximately 615 $g.l^{-1}$ of $NiCl_2$ and approximately 2 $mol.l^{-1}$ of HCl.

6. The process according to claim 1, wherein said chemically etching step is carried out at ambient temperature for between 5 and 10 minutes.

7. The process according to claim 1 or 2, comprising the following successive stages:

(i) cleaning by an organic solvent, such as trichloroethylene or perchbroethylene, (ii) wet sandblasting, (iii) hot pickling with a soda solution, followed by rinsing in water, (iv) pickling with a nitric acid solution, followed by rinsing in water, (v) chemical etching using a solution of nickel chloride $NiCl_2$ and hydrochloric acid, followed by rinsing in water, (vi) pickling with a nitric acid solution, followed by rinsing in water, (vii) pickling with a soda solution, followed by rinsing in water, and (viii) pickling with a nitric acid solution, followed by rinsing in water.

8. The process according to claim 7, wherein the said pickling by the soda solution is carried out hot.

9. A process for depositing a nickel coating on the surface of a uranium-vanadium part, comprising subjecting the said uranium-vanadium part to a surface preparation treatment according to claim 1 or 2 and then depositing a nickel coating on the said uranium-vanadium part by chemical nickel-plating.

10. The process according to claim 1, wherein before carrying out the said chemically etching step the uranium-vanadium part undergoes cleaning by an organic solvent.

11. The procees according to claim 1, wherein before carrying out the said chemically etching step the uranium-vanadium part undergoes sandblasting.

12. The process according to claim 1, wherein before carrying out the said chemically etching step the uranium-vanadium part undergoes pickling in a soda solution.

13. The process according to claim 1, wherein before carrying out the said chemically etching step the uranium-vanadium part undergoes pickling in a nitric acid solution.

14. The process according to claim 1, wherein following said chemically etching step, said uranium-vanadium part undergoes pickling by a nitric acid solution.

15. The process according to claim 1, wherein following said chemically etching step, said uranium-vanadium part undergoes pickling by a soda solution.

* * * * *